US005433082A

United States Patent [19]

Trulaske

[11] Patent Number: 5,433,082

[45] Date of Patent: Jul. 18, 1995

[54] REFRIGERATION SYSTEM FOR A COOLER

[75] Inventor: Robert J. Trulaske, Huntleigh, Mo.

[73] Assignee: True Manufacturing Co., Inc., O'Fallon, Mo.

[21] Appl. No.: 159,834

[22] Filed: Nov. 30, 1993

[51] Int. Cl.[6] ..... A47F 3/04

[52] U.S. Cl. ..... 62/255; 62/407

[58] Field of Search ..... 62/246, 252, 255–256, 62/404, 407, 440, 455, 408

[56] References Cited

U.S. PATENT DOCUMENTS

| | | | |
|---|---|---|---|
| 1,719,809 | 7/1929 | Kucher | 62/407 |
| 2,677,941 | 5/1954 | Warnick | 62/408 |
| 2,732,689 | 1/1956 | Shreve | 62/256 |
| 2,902,840 | 9/1959 | Smith | 62/407 |
| 3,115,019 | 12/1963 | Rutischauser | 62/256 |
| 3,306,068 | 2/1967 | Allgeyer et al. | 62/255 |
| 3,366,432 | 1/1968 | Carmer | 62/255 |
| 4,314,457 | 2/1982 | Ibrahim | 62/256 |
| 4,977,754 | 12/1990 | Upton et al. | 62/248 |
| 5,086,627 | 2/1992 | Borgen | 62/229 |

FOREIGN PATENT DOCUMENTS

| | | | |
|---|---|---|---|
| 3522750 | 1/1987 | Germany | 62/246 |
| 4151485 | 5/1992 | Japan | 62/404 |

*Primary Examiner*—Henry A. Bennet
*Assistant Examiner*—William C. Doerrler
*Attorney, Agent, or Firm*—Cohn, Powell & Hind

[57] ABSTRACT

This cooler refrigeration system is for a cooler (10) having a storage compartment (12) including opposed side walls (16) an upper wall (18), a lower wall (20), and front and rear walls (22, 24) at least one of said front and rear walls (22, 24) providing an access door. The storage compartment (12) includes a circulation system (30) including a duct (32) disposed below the upper wall (18) providing an air inlet (34) in the midportion and air outlets (36) at the opposed end portions. The circulation system (30) provides two counter air flow paths A1, A2 by drawing air upwardly through the air inlets (34) by fans (40), cooling said air by directing the air outwardly across coils (38) disposed between each air inlet (34) and each air outlet (36) and directing said cooled air downwardly through each air outlet (36) and guiding the air along opposed side walls (16) to said lower wall (20) to be again drawn upwardly into the air inlet (34).

10 Claims, 2 Drawing Sheets

FIG. 1.
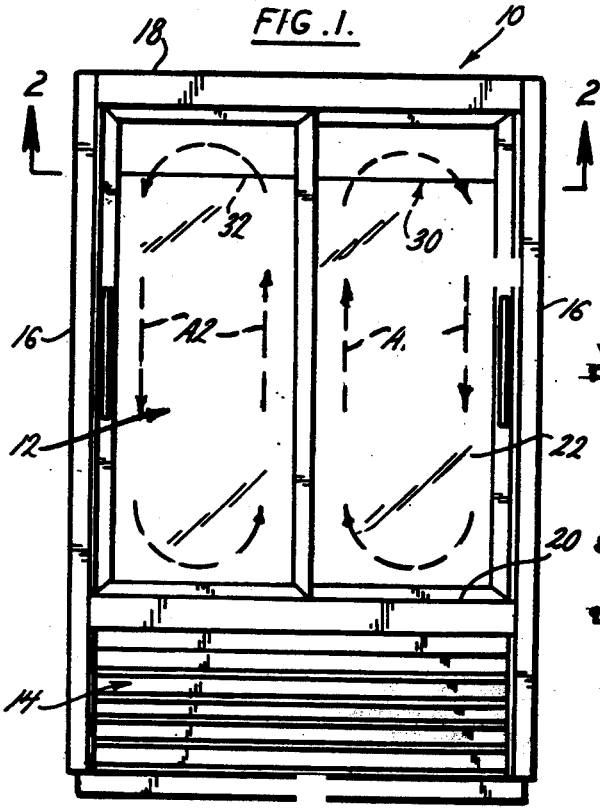
FIG. 5.
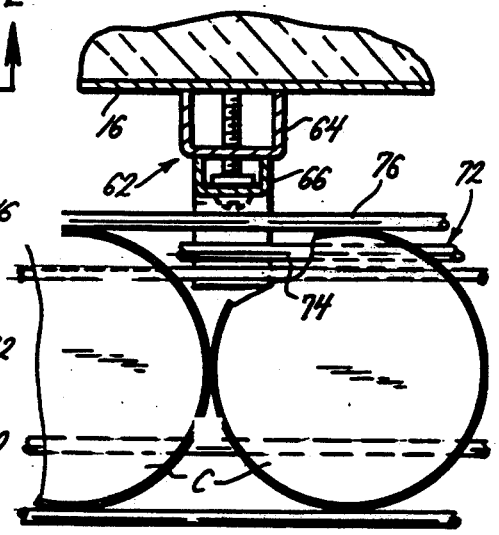
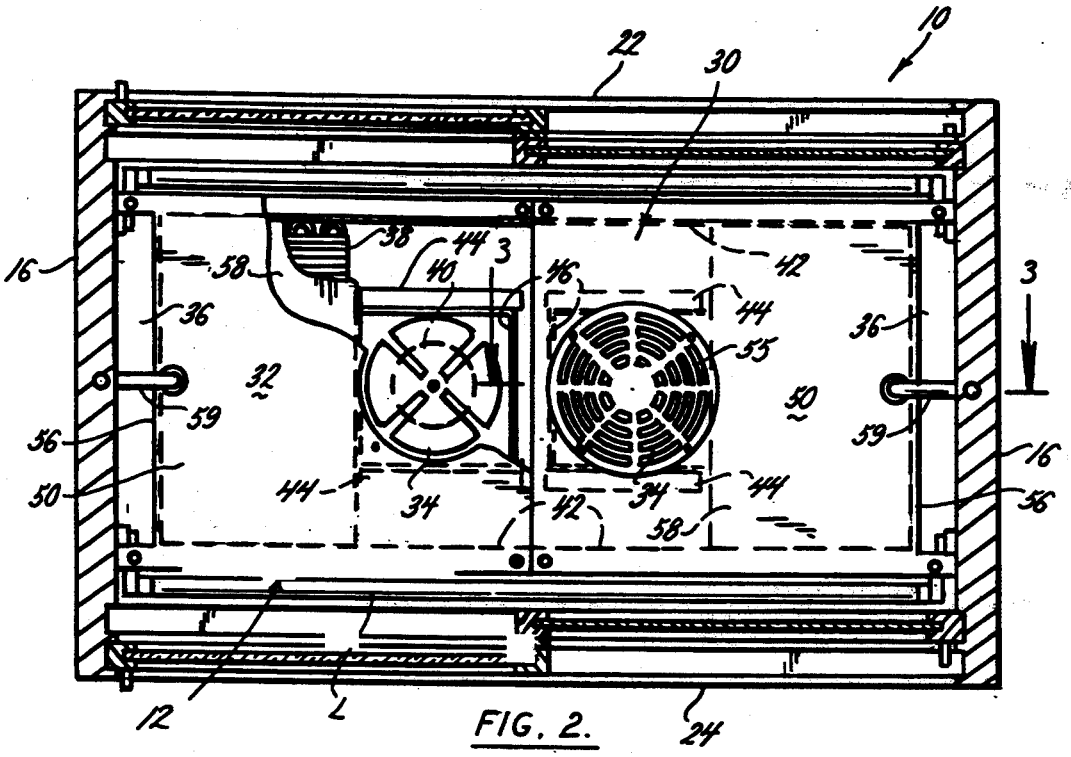
FIG. 2.

REFRIGERATION SYSTEM FOR A COOLER

BACKGROUND OF THE INVENTION

This invention relates generally to a refrigeration system for a cooler and more particularly to a dual air circulation system for a cooler storage compartment.

There are many different types of coolers with refrigeration systems. One increasingly popular type of cooler is the pass-through merchandiser beverage cooler having front and rear glass access doors, and which is used primarily in supermarkets. The most common means of cooling the pass-through merchandiser is a simple circulation refrigeration system with air flow down one side wall and up the opposite side wall. Another means of cooling is by a transverse circulation with air flow down either the front or rear wall and up the opposing wall.

These two systems work quite well, but suffer from several disadvantages. One disadvantage, particularly with the latter system, which usually has both front and rear access doors, is that a considerable amount of condensation forms on the glass doors intended for viewing, with the result that a customer is then unable to view product without opening the cooler door. Another disadvantage is that since the pass-through merchandiser is primarily intended for beverages, the front and rear access doors are opened frequently and a substantial amount of cold air is lost. This loss causes beverages to be warmer than desired and it increases compressor run times. To keep beverages cold, the traditional cooler must operate at high compressor run times which decreases longevity of the merchandiser. Prior art pass-through merchandisers also have a problem with pull-down time of refrigerated products which is a particular disadvantage for a quick moving product such as canned and bottled beverages.

This invention solves these and other problems in a manner not revealed in the known prior art.

SUMMARY OF THE INVENTION

This refrigeration system provides the advantage of a dual circulation refrigeration system for a cooler to decrease pull-down time which is necessary for fast moving product such as canned and bottled beverages.

The refrigeration system also provides a unique way to dispense and circulate the cooled air coming from the coils to minimize condensation. This improved circulation results in improved visibility through the glass doors for viewing product by directing the cooled air against the insulated side walls of the cooler rather than the glass doors providing the front and rear walls, to minimize the loss of refrigerated air when the doors are opened.

By minimizing the loss of cool air, the refrigeration system further provides lower compressor run-times for greater longevity of the system.

It is an aspect of this invention to provide a cooler refrigeration system comprising a storage compartment including opposed side walls, an upper wall, a lower wall and front and rear walls at least one of said front and rear walls defining door access means; circulation means including duct means disposed below the upper wall and having a midportion and opposed end portions, the midportion including air inlet means and the end portions including air outlet means, and the circulation means being arranged to draw air upwardly through the inlet means, cool said air and direct said cooled air downwardly through the outlet means to provide two counter flow air paths each defined by an opposed sidewall and said bottom wall.

It is another aspect of this invention to provide that the circulation means includes fan means and coil means disposed within the duct means.

It is still another aspect of this invention to provide that the fan means includes a pair of fans disposed in side by side relation in the midportion of the duct means, and to provide that the coil means includes a pair of coils each disposed intermediate said inlet means and an associated outlet means.

It is yet another aspect of this invention to provide that the circulation means includes guide means guiding the air downwardly adjacent said side walls.

It is another aspect of this invention to provide that the guide means includes a pair of spaced elongate members extending inwardly from said side walls and cooperating with said side walls to define an air flow guide channel.

It is yet another aspect of this invention to provide that the storage compartment includes a plurality of product-carrying shelves having opposed end portions disposed in spaced relation from an associated side wall and defining guide means guiding air flow downwardly when the shelf is loaded with product It is still another aspect of this invention to provide that the guide means includes a pair of generally vertical spaced elongate members extending inwardly from said side walls, said elongate members having first portions attached to said side walls and second portions attached to said first portions and receiving shelf-supporting brackets at vertically spaced intervals, and the storage compartment includes a plurality of product-carrying shelves having end portions carried by said brackets in spaced relation from an associated side wall to further define said guide means.

It is another aspect of this invention to provide that the duct means includes a partition wall means disposed between the air inlet means, and side wall means directing air outwardly through the coil means.

It is an aspect of this invention to provide a pass-through merchandiser which is relatively inexpensive to manufacture, easy to use, and operates effectively for its intended purpose of cooling fast moving product.

BRIEF DESCRIPTION OF THE DRAWINGS

FIG. 1 is a front elevational view of the cooler;

FIG. 2 is an enlarged underside plan view taken on line 2—2 of FIG. 1;

FIG. 5 is an enlarged fragmentary view taken on line 5—5 of FIG. 4.

DESCRIPTION OF THE PREFERRED EMBODIMENT

Figure 3:
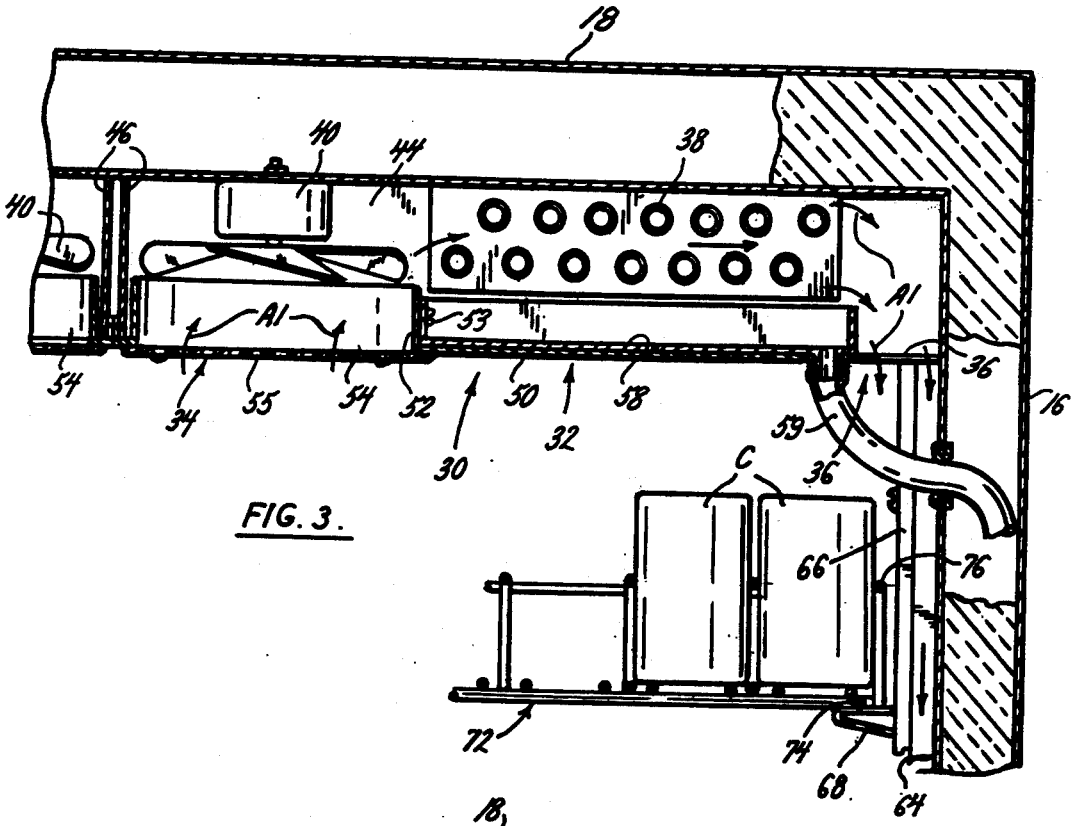
FIG. 3 is an enlarged fragmentary view taken on line 3—3 of FIG. 2.

Referring now by reference numerals to the drawings and first to FIGS. 1 and 2 it will be understood that the cooler 10 includes an upper storage compartment 12 and a lower compressor compartment 14. The storage compartment 12 includes opposed side walls 16, an upper wall 18, a lower wall 20 and front and rear walls 22 and 24. The side walls 16, upper wall 18 and lower wall 20 are insulated and, in the embodiment shown, the front and rear walls 22 and 24 are provided by sliding access doors having triple-pane glass for clear viewing of the product by the customer.

The cooler storage compartment 12 is provided with a refrigeration system which includes a circulation system by which air is circulated in the storage compartment 12 in two counter airflow paths as indicated by A1 and A2 in FIG. 1, the paths being generally parallel to the sliding doors 22 and 24.

The circulation means, generally indicated by numeral 30, includes duct means 32 having air inlet means 34 at the midportion and air outlet means 36 at each end. A pair of coils 38, constituting coil means, is provided each being disposed between the air inlet means 34 and an associated air outlet means 36. The coils 38 cool the air as it is drawn into the duct means 32 by a pair of fans 40, constituting fan means, and passes over the coils 38 before being discharged through the air outlet means 36. The air is guided downwardly by the side walls 16 and across the lower wall 20 to be drawn upwardly as it reaches the midportion of the storage compartment 12 to provide the two distinct clockwise and counterclockwise circulation paths indicated by A1 and A2.

Figure 4:
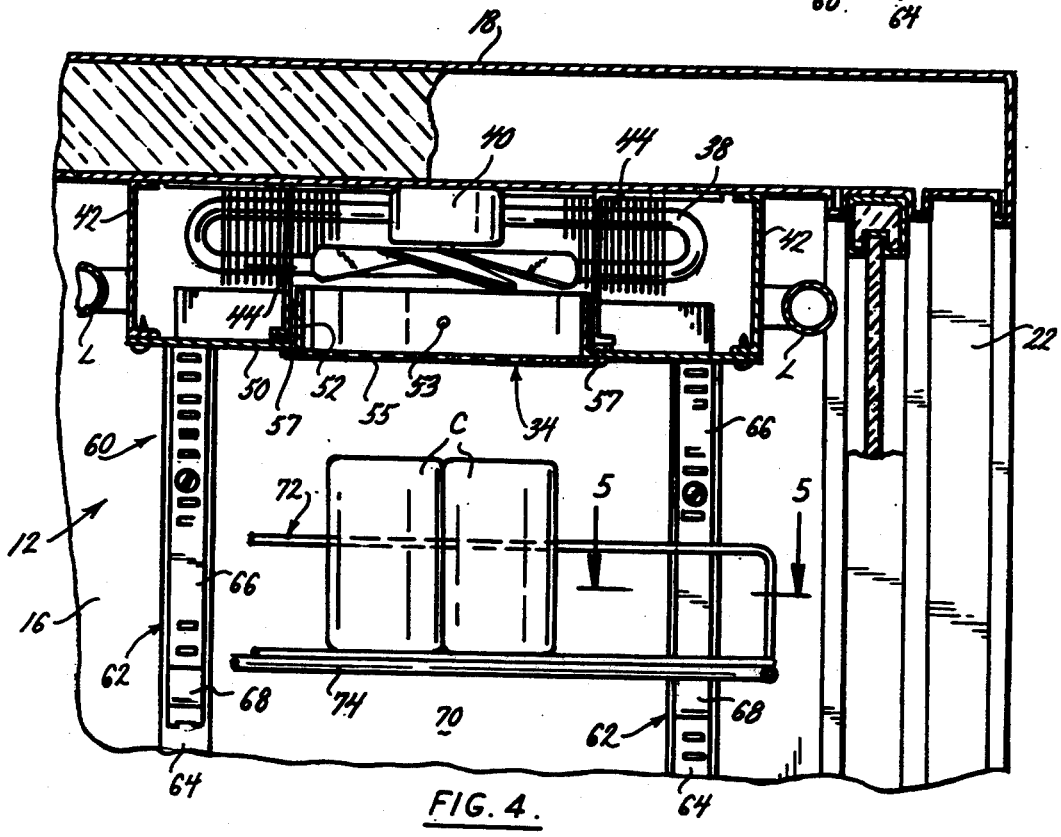
FIG. 4 is a fragmentary view taken on line 4—4 of FIG. 3.

More specifically, and as best shown in FIGS. 3 and 4, the duct means 32 includes a pair of outer members 42 extending the full width of the storage compartment 12 between the inside of the side walls 16, and supporting tubular side lights L, and a pair of inner members 44 extending over the midportion of the duct means 32 and between the coils 38 and having a pair of central partition members 46 connected there between. This structural arrangement of parts provides that the partition members 46 and the inner members 44 provide wall means directing air outwardly from the air inlets 34 through the coils 38 to the air outlets 36. The duct means 32 also includes a pair of cover members 50, which are removably connected to the outer members 42 as by corner fasteners. At the inner end, each cover member 50 is provided with an upwardly extending cylindrical shroud member 52, attached thereto as by welding, and defining openings 54, disposed in side-by-side relation which cooperate to provide the air inlet means 34. Each opening is provided with a removable grill 55 disposed below an associated fan. At the outer end each cover member 50 is notched to provide a U-shaped opening 56 which defines the air outlet means 36. Between its ends each cover member 50 includes a water tray 58 attached thereto as by adhesive and disposed below an associated coil 38 and preferably attached to the water tray 58 as by fastener 53. The water trays are provided with a drainage tube 59 passing through associated side walls 16.

It can be seen in FIG. 3 that each fan 40 is disposed above an associated air inlet opening 54 for drawing the air upwardly into one side or the other of the duct means 32 which is separated into two sides by virtue of the partition members 46. The air is directed outwardly through the duct means 32 by the inner members 44, which are sealed from the cover 50 by seals 57 to minimize air loss, and across the coils 38 for cooling the air. The cooled air is then directed downwardly through the air outlet means 36 along the opposed side walls 16, The air outlet opening 56 is elongate extending less than the width of the associated side wall 16 and is narrow enough to direct the air flow downwardly adjacent the side wall 16, without immediately dispersing the air throughout the cooler storage compartment 12. This arrangement facilitates dual circulation of air flow consisting of two counter air flow paths as indicated by A1 and A2 in FIG. 1.

In order to further facilitate the direction of air flow and as shown in FIGS. 3 and 4, the cooler circulation system 30 includes guide means 60 directing the air from the air outlet means 36 downwardly adjacent the side walls 16. The guide means 60 in the preferred embodiment includes a pair of spaced elongate members 62 on each side wall 16. These elongate members 62 extend inwardly from said side walls 16 thereby defining an air flow guide channel 70 adjacent the side walls 16. In the embodiment shown, the elongate members 62 include a first portion 64 formed integrally or with the side walls 16 and a second portion formed from a rail 66 having spaced shelf-receiving brackets 68 disposed at selected vertical intervals and attached to said first portion as by fasteners. The cooler storage compartment 12 includes a plurality of shelves 72 as shown in FIGS. 3 and 4. The air flow channel 70 is further defined by these shelves 72 having opposed end portions 74 and rails 76 disposed in spaced relation from the storage compartment side walls 16 of the cooler 10 by engagement with the brackets 68. The side wall 16 between the elongate members 62 forms one side of the guide channel 70; the pair of elongate members 62 running parallel to the side wall 16 and extending inwardly from it form two sides of the guide channel 70; and the fourth side of the guide channel 70 is provided by rails 76 of the plurality of shelves 72 spaced inwardly from the side wall 16 and guide members 62. When the shelves 72 are loaded with beverage containers C, the air flow guide channel 70 is further defined vertically.

In the embodiment shown the insulated cooler side walls 16 bottom wall 20 and top wall 18 are formed from stainless steel outer walls with aluminum liners and foamed-in-place high density polyurethane insulation but other material could be utilized. Likewise, the front and rear walls 22, 24 providing door means are preferably formed from triple pane glass for colder product and easy viewing. The shelves 72 may be of the adjustable vinyl coated wire variety, providing a means for air flow between shelves 72.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. A self-contained cooler refrigeration system comprising:

(a) a generally rectangular closed storage compartment including opposed side walls, an upper wall, a lower wall and front and rear walls at least one of said front and rear walls defining door access means substantially of glass, (b) circulation means including duct means disposed below the upper wall and having a midportion and opposed end portions, the midportion including air inlet means and the end portions including air outlet means located adjacent the side walls, and (c) the circulation means being arranged to draw air upwardly through the inlet means, to direct said air toward the side walls, cool said air and direct said cooled air downwardly through the outlet means adjacent the side walls to provide two counter flow air paths each defined at least in part by an opposed side wall.

2. A cooler refrigeration system as defined in claim 1, in which:

(d) the circulation means includes fan means and coil means disposed within the duct means.

3. A cooler refrigeration system as defined in claim 2, in which:

(e) the fan means includes a pair of fans disposed in side by side relation in the midportion of the duct means.

4. A cooler refrigeration system as defined in claim 2, in which:

(e) the coil means includes a pair of coils each disposed intermediate said inlet means and an associated outlet means.

5. A cooler refrigeration system as defined in claim 1, in which:

(d) the circulation means includes guide means associated with the side walls and receiving air from the duct end outlet means for guiding the air downwardly adjacent said side walls.

6. A cooler refrigeration system as defined in claim 5, in which:

(e) the guide means includes a pair of spaced elongate members extending inwardly from said side walls and cooperating with said side walls to define an air flow guide channel on said side walls.

7. A cooler refrigeration system as defined in claim 1, in which:

(d) the storage compartment includes a plurality of product-carrying shelves having opposed end portions disposed in spaced relation from an associated side wall and defining guide means guiding air flow downwardly when the shelf is loaded with product.

8. A cooler refrigeration system as defined in claim 5 in which:

(e) the guide means includes a pair of generally vertical spaced elongate members extending inwardly from said side walls, said elongate members having first portions attached to said side walls and second portions attached to said first portions and receiving shelf-supporting brackets at vertically spaced intervals, and (f) the storage compartment includes a plurality of said shelves having end portions carried by said brackets in spaced relation from an associated side wall to further define said guide means.

9. A cooler refrigeration system comprising:

(a) a storage compartment including opposed side walls, an upper wall, a lower wall and front and rear walls, each of said front and rear walls defining door access means, and a plurality of shelves, (b) circulation means including:

1. duct means disposed below the upper wall and having a midportion including a pair of air inlet means disposed in side-by-side relation and opposed end portions including air outlet means, said duct means housing a pair of fan means each disposed above an air inlet means and coil means disposed between each fan means and said air outlet means, and 2. guide means on each side wall including generally vertical elongate members each having a first portion unitarily formed with the side wall to define an air flow guide channel and a second portion attached to said first portion and receiving shelf-supporting brackets at vertically spaced intervals, and operatively supporting said shelves, said shelves being adapted to carry product in spaced relation to said side walls to further define said guide means.

10. A cooler refrigeration system as defined in claim 9, in which:

(c) the duct means includes a partition wall means disposed between the air inlet means and side wall means directing air outwardly through the coil means.

* * * * *